United States Patent [19]

Gerretz

[11] Patent Number: 5,035,132

[45] Date of Patent: Jul. 30, 1991

[54] APPARATUS FOR ROTATING AND ADVANCING STOCK IN PILGRIM STEP COLD ROLLING MILLS

[75] Inventor: Josef Gerretz, Viersen, Fed. Rep. of Germany

[73] Assignee: Mannesmann AG, Fed. Rep. of Germany

[21] Appl. No.: 170,284

[22] Filed: Mar. 18, 1988

[30] Foreign Application Priority Data

Mar. 19, 1987 [DE] Fed. Rep. of Germany ..... 3709008

[51] Int. Cl.[5] ..... B21D 7/02

[52] U.S. Cl. ..... 72/214; 72/251

[58] Field of Search ..... 72/214, 251

[56] References Cited

U.S. PATENT DOCUMENTS

| | | | |
|---|---|---|---|
| 4,154,079 | 5/1979 | Peytavin | 72/214 |
| 4,386,512 | 6/1983 | Rehag et al. | 72/214 |
| 4,562,713 | 1/1986 | Kondoh | 72/214 |
| 4,641,513 | 2/1987 | Peytavin | 72/214 |
| 4,658,617 | 4/1987 | Peytauin | 72/214 |

FOREIGN PATENT DOCUMENTS

| | | | |
|---|---|---|---|
| 2424907 | 12/1974 | Fed. Rep. of Germany | 72/214 |
| 0364366 | 12/1972 | U.S.S.R. | 72/214 |

*Primary Examiner*—Irene Cuda

*Attorney, Agent, or Firm*—Ralf H. Siegemund

[57] ABSTRACT

Rolled stock is turned and advanced by a devicce that includes two separate motors the two motors being provided, being provided for turning while the advancing is of the stock results from a speed differential between the motors as they drive the stock.

7 Claims, 1 Drawing Sheet

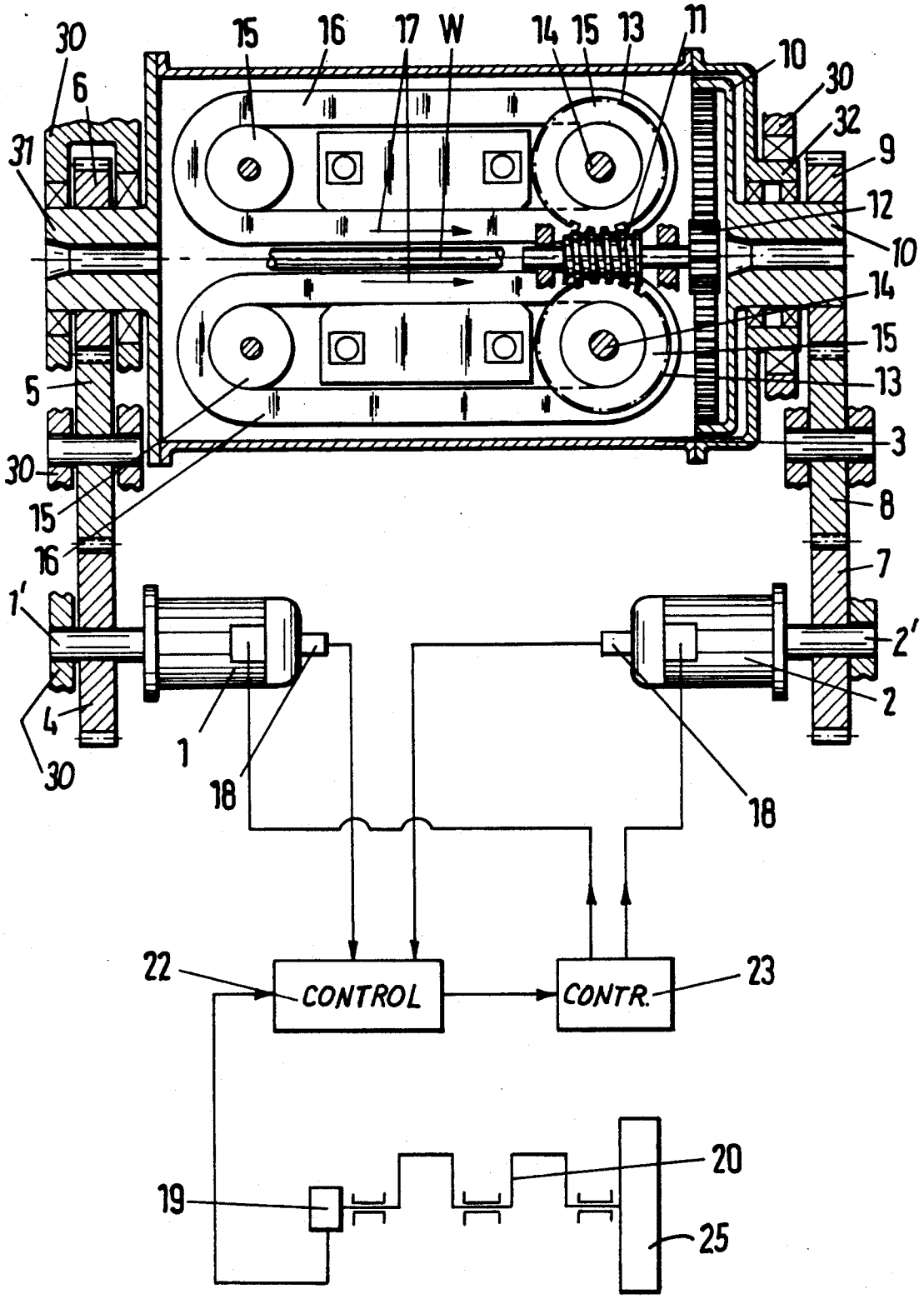
30
6
31
15
16
17
W
14
15
13
11
10
30
32
9
12
10
14
15
13
3
8
7
2'
2
5
30
15
16
1'
4
30
1
18
18
22
CONTROL
CONTR.
23
19
20
25

APPARATUS FOR ROTATING AND ADVANCING STOCK IN PILGRIM STEP COLD ROLLING MILLS

BACKGROUND OF THE INVENTION

The present invention relates to turning and advancing rolled stock, particularly elongated stock for, of and in a pilgrim step type rolling mill, wherein specifically, the work piece such as a rolled stock is gripped between transport elements of the endless variety pertaining to a stock advancing device, and being capable of turning on a longitudinal axis of the rolled stock.

Cold rolling with a reciprocating rolling stand requires that occasionally, e.g. on each stroke of the frame, that the work piece and rolled stock be turned by a certain angle, and the stock also advanced. The known devices provide for the turning and for the advancing in separate steps and by means of separate devices. In each instance the movement, whether rotation or advance, has to be transmitted from a motion producing device, through the clamping structure on a carriage upon the work piece. From a practical point of view these movements are imparted in stock on the dead center position, or in a return point of the frame as this occurs on account of the regular pilgrim step motion. Rotating and advancing can be carried out separately because for each there are two dead center points and positions per cycle. Alternatively, turning and advancing can be superimposed and carried out concurrently in one or both of the dead centers. After the clamping carriage together with the work piece it holds has reached a particular terminal position the clamps are opened and the carriage is retracted. Now the mill is stopped. This stopping of the mill and feeding of the device is time consuming. Moreover, the tolerances are actually changed in each instance as far as the equipment and the rolled stock is concerned since this frame stops on the rolled stock and any change in temperature directly interferes with the dimensional tolerances.

Certain continuously working structures and mills are known, e.g. those of the kind described in the German printed patent application 20 34 315. These structures are of economical construction for the following reasons. The stationary turning and advancing device is characterized by endless transport elements. The work piece is gripped by an advancing structure that acts between the endless transport elements. The advancing device is, in addition, rotatable about a longitudinal axis. Rotation and advance is transmitted on the work piece in this case through a device characterized by a device 8 rather compact design and being designed to avoid slippage. The device includes endless elements such as belts, chains or the like movably arranged in a rotatable casing, frame or housing. This housing and the advance structure are driven through transmission trains and the several trains are connected to a common main drive and transmission. One transmission train provides rotation, and the other one provides advance. Both of them are interconnected through a planetary gear. The rotation of the housing will not advance the transport element, for the advance and vice versa. To deal with this problem, and because of the transmission ratio in the planetary gears, the wheel for the pinion that meshes the gear of the advancing transmission is rotated synchronously. A rotation of the worm relative to the casing is thus excluded. The advance may be changed through control in the particular transmission branch.

The rotation of the housing together with the advance device, does not interfere with the advance itself.

The known structures, basically, operate satisfactorily but have the disadvantage of a very high degree of complexity and, therefore, of expenditure. In particular, interposing a planetary gear between two transmission trains constitutes a formidable cost factor. Moreover, the time for rotating and advancing is predetermined because of certain cam devices on a cam structure. The mode of operation can be changed only through an exchange in the cam arrangement. This kind of transmission is very expensive to make and to operate.

DESCRIPTION OF THE INVENTION

As a starting point and as a feature of the invention, the basic teaching of German printed patent application 20 34 315 is used and the mode of continuously operating rotating and advancing devices is potentially retained, but deemed optional. Essential is that rotation and advance be separately provided for in terms of movement.

In addition, it is an object of the present invention to improve structure of the kind to which the invention pertains, not only with regard to function, but also with regard to the constructural complexity so as to provide a more economical arrangement.

In accordance with the preferred embodiment of the present invention, it is suggested to provide separate motors such as electromotors or hydraulic motors for advancing and rotating the work piece in a pilgrim step mill. Therefore it is a principal feature of the invention to replace mechanical step switching transmission devices or the like by separate motors. Owing to this particular mode of operation, step switch gears and differentially operating planetary gears are omitted.

In accordance with further features and aspects of the invention, the transport elements for rotating and for advancing are geared to a worm mounted in a rotatable housing or casing, which worm engages respective gears of the transport elements. The worm is connected through a pinion gear and an internal gear to one of the motors. The housing is geared to the other motor. The advancing is obtained through the difference in rotation between the two motors; both operating in synchronism with a crank drive of the cold pilgrim step mill, and in an intermittent and/or variable rotation mode. The controllable advance is produced in that a basic rotation is provided and depends on the particular adjusted rotation of the housing and a further advance producing rotation is superimposed upon the basic rotation, the superimposed rotation being proportional to the desired advance. The rotation of the worm-plus-pinion now results from the difference between the basic rotation and the actual rotation of the motor associated with the drive wheel.

It is a particularly favorable feature of the invention to provide the motor shafts with rotation indicating and representing transducers which cooperate with further transducer(s) on the crank drive of the pilgrim step mill and together providing the requisite inputs for the control of the aforementioned motors. As a consequence, one obtains a number of advantages which are already mentioned in German patent 19 39 914.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates, partially in cross section and partially in terms of a diagram, a preferred embodiment of the present invention for practicing the best mode thereof.

Proceeding to the detailed description of the drawings, reference numeral 25 refers to the reciprocating frame part in a pilgrim step type cold rolling mill and including particularly a crank drive 20. An example is disclosed in my above referenced copending U.S. patent application and is mentioned here only for purposes of background and completion.

The device and apparatus in accordance with features and aspects of the invention includes two motors 1 and 2; they may be electromotors or hydromotors and respectively providing the rotation for a rolled stock and work piece and for advancing the rolled stock and workpiece for pilgrim step type of rolling. The motors are mounted in a stationary stand or frame 30.

A housing 3 is provided with hollow axles or studs 31 and 32 for purposes of journalling the housing in stationary part 30. Reference character W denotes the work piece and rolled stock being a rodlike element or hollow that traverses the housing centrally and passes through the hollow interiors of studs 31 and 32. The housing 3 is rotated by operation of the motor 1 under utilization of gears 4,5,6 establishing a gear and transmission train that leads from the shaft 1' of motor 1 to journal pin, shaft or stud 31 of the housing, frame or casing 3. This rotation will, as will be explained shortly, be imparted as rotation upon the work piece and rolled stock W.

The advance of the rolled stock W is provided through the motor 2 having an output shaft 2' which in turn is connected to a train of gear wheels 7,8,9. Wheel 9 is mounted on a stud 10' of a hollow gear 10. Stud 10' is journalled inside hollow shaft or stud 32. Gear 10 meshes a pinion 12 which in turn is mounted on and is part of a shaft having a worm 11. Pinion 12 and worm 11 are laterally offset in relation to the coaxial studs 31,32 and 10'. Certain gears 13 mesh with the worm 11, and these gears 13 sit on shafts 14 respectively pertaining to deflection and/or reversal rollers 15 of endless transport devices 16. There are two devices shown.

The belts or chains of the two transport devices 16 are driven in the direction of the arrow 17 and grip the rolled stock W for purposes of advancing it or, at least as far as rotation is concerned, holding it during the rotation. Aside from driving the transport element 16 whenever that is desired, motor 2 compensates and suppresses undesired and unintended advance of the element 16. This undesired movement may result whenever the pinion 12 happens to be rotated while the housing 3 is rotated through the motor 1. Owing to the engagement with gear rotation is imparted on gear 11 as the housing 3 rotates.

The operation of the motors 1 and 2 is controlled by a control circuit 23. As further shown, transducers 18 are respectively coupled to the motors 1 specifically are coupled to the shafts of the motors and therefore provide signals proportional to the respective speed of rotation. On the other hand, transducers 19 are provided on the crank 20 which advances and reciprocates the frame for the pilgrim step rolling operation. All these transducers act on a controller 22 which in turn is connected to and acts on the controller 23 with the two motors 1 and 2.

Whenever the advance is to remain off, motor 2 and motor 1 run at the same speed and provide similar basic rotation which is imparted on the hollow wheel 10 as well as housing such that no relative rotary motion obtains between worm 11 on one hand and the housing 3 on the other hand. There is the dynamic equilibrium by means of which the speed differential between these devices is zero.

The controllable advance obtains by superimposing on a basic rotation as described a supplemental and advance producing rotation. This supplemental rotation is chosen to be proportional to the desired advance. The control 23 provides for that function. The rotation of pinion 12 now produced generally obtains through the difference between the basic rotation as defined and the actual rotation of the motor 2. In this case then, the basic rotation is the rotation of the housing 3. Of course, there occurs neither any rotation nor any advance when both motors are off.

It can thus be seen that owing to appropriate control of the motors 1 and 2, any kind of combination of rotational motion and advance motion can be produced through the formation of appropriate component rotation. The differences will then produce the actual movement, without requiring extensive transmission devices.

The invention is not limited to the embodiments described above but all changes and modifications thereof, not constituting departures from the spirit and scope of the invention, are intended to be included.

I claim:

1. A device for turning and advancing rolled stock in a pilgrim step cold rolling mill comprising:

transport means of the endless variety for gripping and advancing the stock;

mounting means for mounting the transport means for rotation about a longitudinal axis so that upon rotation of the transport means about said longitudinal axis, the stock rotates about said longitudinal axis;

first motor means for connection to the transport means for driving the same to obtain an advancing of the stock as it is gripped by the transport means;

first transmission means connected to the first motor means and the transport means to obtain said driving and said advancing; and second motor means connected to the transport means to obtain said rotation of the transport means.

2. Device as in claim 1 including control means connected to the first and second motor means, there being a crank drive in the mill, the crank drive being connected to the control means to synchronize operations of the first and second motor means.

3. Device as in claim 1, the means for mounting being a housing, the second motor means connected to the housing to rotate the housing to obtain said rotation of the transport means.

4. Device as in claim 3, including a worm gear in the housing, the endless transport means including gears meshing with the worm gear, and further including gear means connected to the worm gear and to the first motion means for driving the transport means.

5. A device for turning and advancing rolled stock in a pilgrim step cold rolling mill comprising:

a pair of endless transport devices for gripping and advancing the stock;

a rotatable housing for mounting the transport devices for rotation about a longitudinal axis so that upon rotation of the housing about said axis, the stock is caused to rotate about its longitudinal axis;

worm gear means drivingly connected to said transport devices;

first motor and gear means connected to the worm gear means for driving same, the housing having hollow stud means through which rotation is provided to the worm gear mean; and second motor and gear means connected to the housing for causing the housing to rotate.

6. Device and apparatus as in claim 5, the first motor and gear means including a pinion on the worm and an internal gear on a shaft, said shaft traversing said hollow stud means.

7. A device for turning and advancing rolled stock in a pilgrim step cold rolling mill comprising:

transport means of the endless variety for gripping and advancing the stock;

a housing for mounting the transport means, the housing being mounted for rotation about a longitudinal axis so that upon rotation of the housing about said axis, the stock rotates about its longitudinal axis;

first motor and gear means connected to the transport means for driving same;

second motor and gear means connected to the housing for rotating the housing and the transport means therein; and control means connected to the first and second motor and gear means so that the rotation is obtained as a result of a rotation as provided by said first and second motor and gear means, and advance is obtained as a result of a speed differential.

* * * * *